US005254028A

United States Patent [19]

Liao

[11] Patent Number: 5,254,028

[45] Date of Patent: Oct. 19, 1993

[54] FLUID RELEASING AND SOUND GENERATING TOY

[76] Inventor: Ming-Kang Liao, 9F, No. 196, Sec. 4, Cheng-Te Rd., Taipei City, Taiwan

[21] Appl. No.: 959,687

[22] Filed: Oct. 13, 1992

[51] Int. Cl.[5] ..... A63H 3/28

[52] U.S. Cl. ..... 446/297; 446/397

[58] Field of Search ..... 446/297, 305, 397, 400, 446/475; 220/901; 222/3, 39, 630; 239/71, 72; 472/52, 53

[56] References Cited

U.S. PATENT DOCUMENTS

| | | | |
|---|---|---|---|
| 945,708 | 1/1910 | De Moulin | 472/53 |
| 2,907,139 | 10/1959 | Rekettye | 446/305 |
| 4,223,804 | 9/1980 | Morris et al. | 222/3 |

*Primary Examiner*—Robert A. Hafer
*Assistant Examiner*—Jeffrey D. Carlson
*Attorney, Agent, or Firm*—Harness, Cickey & Pierce

[57] ABSTRACT

A fluid releasing and sound generating toy includes a toy body, a container, an electric valve, a tube, a sound generating unit, a receiving circuit and a controller unit. The toy body has a chamber formed therein and includes a fluid discharge hole formed in the outer surface of the toy body. The container contains compressed fluid therein and is disposed removably in the chamber of the toy body. The electric valve is connected operatively to the container and is activated to release the compressed fluid from the container. The tube is connected detachably to the electric valve at one end thereof and is communicated with the fluid discharge hole of the toy body so as to allow the compressed fluid to flow out of the toy body from the fluid discharge hole. The sound generating unit is disposed securely in the toy body so as to be activated to generate sound. The receiving circuit is positioned in the toy body and is connected electrically to the electric valve and the sound generating unit. The controller unit is actuatable so as to transmit an electrical signal to the receiving circuit in order to activate the electric valve to release the compressed fluid from the container, and to activate the sound generating unit to generate sound at the same time.

6 Claims, 2 Drawing Sheets

FLUID RELEASING AND SOUND GENERATING TOY

BACKGROUND OF THE INVENTION

1. Field of the Invention

This invention relates to a toy, more particularly to a toy which is operable so as to release fluid and generate sound at the same time.

2. Description of the Related Art

Presently, there are many types of toys which are available in the market. However, all of the conventional toys can either generate sound or release fluid only.

SUMMARY OF THE INVENTION

Therefore, the main objective of the present invention is to provide a toy which is operable so as to release fluid and generate sound at the same time.

According to this invention, a fluid releasing and sound generating toy includes a toy body, a container, an electric valve, a tube, a sound generating unit, a receiving circuit and a controller unit. The toy body has a chamber formed therein and includes a cover attached to the toy body and covering the chamber, and a fluid discharge hole formed in the outer surface of the toy body. The container contains compressed fluid therein and is disposed removably in the chamber of the toy body. When the cover is opened to uncover the chamber, the container can be removed from the chamber. The electric valve is connected operatively to the container so as to be activated to release the compressed fluid from the container. The tube is connected detachably to the electric valve at one end thereof and is communicated with the fluid discharge hole of the toy body so as to allow the compressed fluid to flow out of the toy body from the fluid discharge hole through the tube. The sound generating unit is disposed securely in the toy body so as to be activated to generate sound. The receiving circuit is positioned in the toy body and is connected electrically to the electric valve and the sound generating unit. The controller unit is actuatable so as to transmit an electrical signal to the receiving circuit in order to activate the electric valve to release the compressed fluid from the container, and to activate the sound generating unit to generate sound at the same time.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
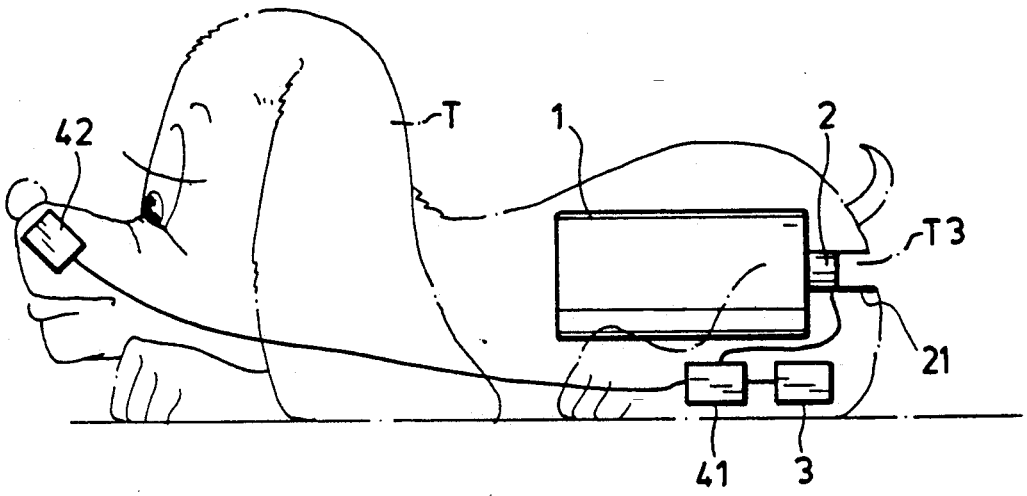
FIG. 1 is a schematic view of a fluid releasing and sound generating toy according to a first embodiment of this invention.
Figure 3:
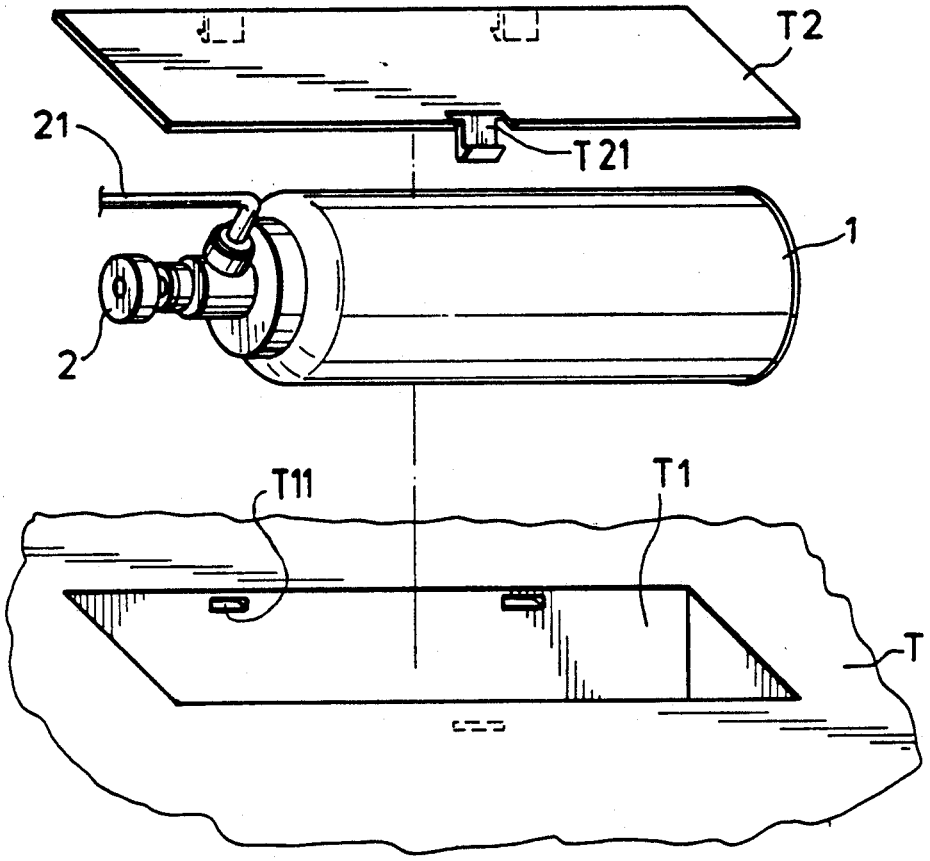
FIG. 3 is an exploded view showing a portion of the toy of this invention.

Referring to FIGS. 1 and 3, a fluid releasing and sound generating toy according to this invention includes a dog-shaped toy body (T), a container (1), an electric valve (2), a tube (21), a sound generating unit (3), a receiving circuit (41) and a controller unit (42).

The toy body (T) may be molded into different shapes, has a chamber (T1) (see FIG. 3) formed therein and includes a cover (T2) (see FIG. 3). The chamber (T1) has a plurality of receiving holes (T11) formed in two sides thereof. A plurality of positioning hooks (T21) project downward from two sides of the cover (T2). Each hook (T21) has a vertical body and a back-curving end with an inclined surface. The ends of the hooks (T21) are engaged within the receiving holes (T11). Accordingly, the cover (T2) is mounted removably on the toy body (T) so as to cover the chamber (T1). A fluid discharge hole (T3) is formed in the outer surface of the toy body (T).

The container (1) contains compressed fluid therein and is disposed removably in the chamber (T1) of the toy body (T). The compressed fluid may be a fragrant gas, pungent gas, tear gas or a liquid which has a fragrant or pungent smell. In this embodiment, the compressed fluid is a pungent gas.

The electric valve (2) is connected operatively to the container (1) so as to be activated to release the compressed fluid from the container (1).

The tube (21) is connected detachably to the electric valve (2) at one end thereof and is communicated with the fluid discharge hole (T3) of the toy body (T) so as to allow the compressed fluid to flow out of the toy body (T) from the fluid discharge hole (T3) through the tube (21). When the container (1) has been fully discharged, it must be replaced by a new one. When replacing the container (1), the cover (T2) is first removed from the toy body (T) to uncover the chamber (T1). The tube (21) is then detached from the electric valve (2), and the container (1) is removed from the chamber (T1) of the toy body (T) and is replaced by a new one. The tube (21) is then connected to the valve of the new container. Finally, the cover (T2) is mounted again on the toy body (T) so as to cover the chamber (T1).

The sound generating unit (3) is disposed securely in the toy body in a known manner so as to be activated to generate sound.

The receiving circuit (41) is positioned securely in the toy body (T) in a known manner and is connected electrically to the electric valve (2) and the sound generating unit (3).

The controller unit (42) is disposed in the toy body (T) in a known manner and is actuated so as to transmit an electrical signal to the receiving circuit (41) in order to activate the electric valve (2) to release the compressed fluid from the container (1), and to activate the sound generating unit (3) to generate sound at the same time.

Figure 2:
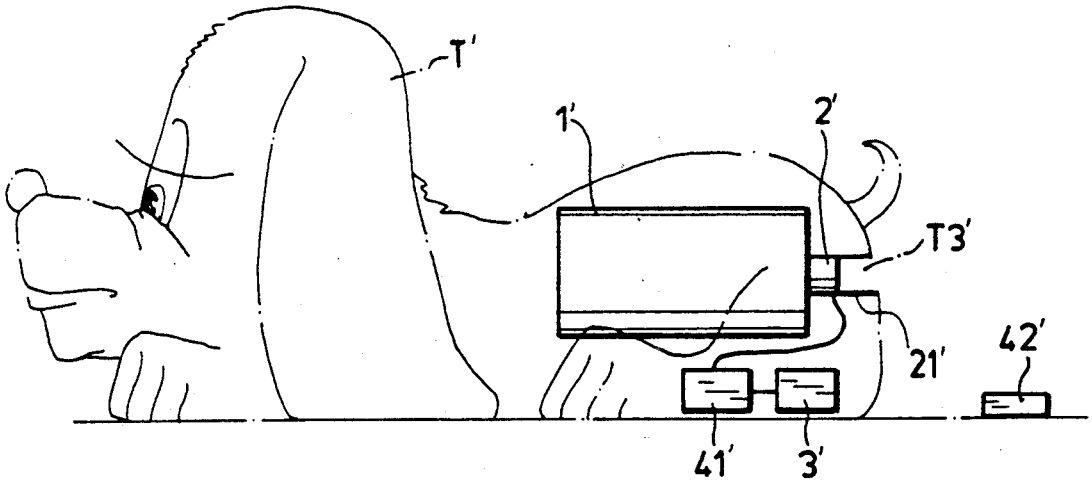
FIG. 2 is a schematic view of the toy according to a second embodiment of this invention.

Referring to FIG. 2, the second embodiment of this invention is shown. Unlike the first embodiment, the controller unit (42') is a wireless controller which can be actuated so as to emit an electric signal to the receiving circuit (41') at a distance from the toy body (T').

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A fluid releasing and sound generating toy, comprising:

a toy body having a chamber formed therein and including a cover attached to said toy body and covering said chamber, and a fluid discharge hole formed in an outer surface of said toy body;

a container containing compressed fluid therein, said container being disposed removably in said chamber of said toy body and being capable of being removed from said chamber when said cover is opened to uncover said chamber;

an electric valve connected operatively to said container so as to be activated to release said compressed fluid from said container;

a tube connected detachably to said electric valve at one end thereof and communicated with said fluid discharge hole of said toy body so as to allow said compressed fluid to flow out of said toy body from said fluid discharge hole;

a sound generating unit disposed securely in said toy body so as to be activated to generate sound;

a receiving circuit positioned in said toy body and connected electrically to said electric valve and said sound generating unit; and a controller unit being actuatable so as to transmit an electrical signal to said receiving circuit in order to activate said electric valve to release said compressed fluid from said container, and to activate said sound generating unit to generate sound at same time.

2. A fluid releasing and sound generating toy as claimed in claim 1, wherein said compressed fluid is a fragrant gas.

3. A fluid releasing and sound generating toy as claimed in claim 1, wherein said compressed fluid is a pungent gas.

4. A fluid releasing and sound generating toy as claimed in claim 1, wherein said compressed fluid is a tear gas.

5. A fluid releasing and sound generating toy as claimed in claim 1, wherein said compressed fluid is a liquid having a fragrant smell.

6. A fluid releasing and sound generating toy as claimed in claim 1, wherein said compressed fluid is a liquid having a pungent smell.

* * * * *